US005363651A

United States Patent [19]

Knight

[11] Patent Number: 5,363,651

[45] Date of Patent: Nov. 15, 1994

[54] FREE PISTON INTERNAL COMBUSTION ENGINE

[76] Inventor: Arthur G. Knight, 3209 58th St. S., Apt. No. 130, Gulfport, Fla. 33707

[21] Appl. No.: 89,281

[22] Filed: Jul. 12, 1993

[51] Int. Cl.[5] ..... F02B 71/04

[52] U.S. Cl. ..... 60/595; 123/90.14; 123/152

[58] Field of Search ..... 60/595; 123/25 C, 90.14, 123/152

[56] References Cited

U.S. PATENT DOCUMENTS

| | | | |
|---|---|---|---|
| 894,622 | 7/1908 | Fricker | 123/152 |
| 2,872,778 | 2/1959 | Dane | 60/595 |
| 2,914,909 | 12/1959 | Kubik | 60/595 |
| 2,924,068 | 2/1960 | Pereda | 60/595 |
| 3,074,228 | 1/1963 | Lee | 123/25 C |
| 3,183,661 | 5/1965 | Peterson | 123/90.14 |
| 3,995,427 | 12/1976 | Demetrescu | 60/595 |
| 4,016,719 | 4/1977 | Yavnai | 60/595 |
| 4,326,380 | 4/1982 | Rittmaster et al. | 60/595 |
| 4,653,274 | 3/1987 | David | 60/595 |
| 4,733,534 | 3/1988 | Southard | 60/595 |

FOREIGN PATENT DOCUMENTS

| | | | |
|---|---|---|---|
| 277090 | 9/1927 | United Kingdom | 123/152 |

*Primary Examiner*—Michael Koczo

*Attorney, Agent, or Firm*—S. Michael Bender

[57] ABSTRACT

An improved internal combustion engine is disclosed having no rotating crank shaft. Each piston rod of the engine is connected to a hydraulic piston and cylinder the output of which drives the rotating output shaft of a hydraulic motor. A take off from the shaft of the hydraulic motor drives an air compressor which feeds compressed air to the combustion chamber through the latter's intake valve. Fuel is mixed with the compressed air before entering the combustion chamber and a conventional spark plug and coil is employed to ignite the fuel/compressed air mixture. The compressed air also is used to actuate the intake and exhaust valves of each cylinder through a solenoid controller. A computer is adapted to send signals to each valve solenoid to control its movement and to each spark plug coil in response to a throttle input and a piston displacement input applied to the computer. The input signal sensing piston displacement in each cylinder is derived from a linear potentiometer coupled between the piston rod and the hydraulic cylinder. The computer also operates a master hydraulic valve between the hydraulic cylinders and the hydraulic motor to control the direction of rotation of the hydraulic motor output shaft. Water injection means are provided for cooling each combustion chamber thereby dispensing with a conventional radiator cooling system.

9 Claims, 6 Drawing Sheets

FREE PISTON INTERNAL COMBUSTION ENGINE

BACKGROUND OF THE INVENTION

1. Field of the Invention

The present invention relates generally to internal combustion engines, and more particularly, to a new and improved internal combustion engine having no rotating crank shaft and no radiator cooling system thereby operating with greatly enhanced efficiency.

2. Description of the Prior Art

In conventional internal combustion engines of either the two-stroke or four-stroke type, efficiency is limited due to losses to friction and to heat lost through the radiator or cooling system. The need to maintain a conventional engine operative when it is not doing any useful work, i.e. when the engine is running and the crank shaft is turning during idling, for example, wastes fuel, reduces efficiency, and creates wear and tear on the engine parts. Similarly, the need of a conventional internal combustion engine to be cooled constantly by causing a stream of cooling fluid to flow through or over the walls of the engine expends approximately a third of the useful output of the engine. Clearly a need exist for a more efficient design of an internal combustion engine which does not require a constantly rotating crank shaft especially when the engine is in "idle," and which does not need to be constantly cooled by an efficiency robbing radiator or cooling system. Such need is met by the present invention as will be made apparent from the following description thereof. Other advantages of the present invention over the prior art also will be made self evident.

SUMMARY OF THE INVENTION

To achieve the foregoing and other advantages, the present invention, briefly described, provides an improved internal combustion engine having no rotating crank shaft. Each piston rod of the engine is connected to a hydraulic piston and cylinder the output of which drives the rotating output shaft of a hydraulic motor. A take off from the shaft of the hydraulic motor drives an air compressor which feeds compressed air to the combustion chamber through the latter's intake valve. Fuel is mixed with the compressed air before entering the combustion chamber and a conventional spark plug and coil is employed to ignite the fuel/compressed air mixture. The compressed air also is used to actuate the intake and exhaust valves of each cylinder through a solenoid controller. A computer is adapted to send signals to each valve solenoid to control its movement and to each spark plug coil in response to a throttle input and a piston displacement input applied to the computer. The input signal sensing piston displacement in each cylinder is derived from a linear potentiometer coupled between the piston rod and the hydraulic cylinder. The computer also operates a master hydraulic valve between the hydraulic cylinders and the hydraulic motor to control the direction of rotation of the hydraulic motor output shaft. Water injection means are provided for cooling each combustion chamber thereby dispensing with a conventional radiator cooling system.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for desisting other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved internal combustion engine which has all of the advantages of the prior art and none of the disadvantages.

It is another object of the present invention to provide a new an improved internal combustion engine which may be easily and efficiently manufactured and marketed.

It is a further objective of the present invention to provide a new and improved internal combustion engine which is of durable and reliable construction.

An even further object of the present invention is to provide a new and improved internal combustion engine which is susceptible of a low cost of manufacture with regard to both materials and labor, and which accordingly is then susceptible of low prices of sale to the consuming public, thereby making such internal combustion engine available to the buying public.

Still yet a further object of the present invention is to provide a new and improved internal combustion engine that has greatly improved efficiency.

It is still a further object of the present invention is to provide a new and improved internal combustion engine that has no moving crank shaft or other parts when the engine is in idle.

Still a further object of the present invention is to provide a new and improved internal combustion engine that requires no cooling radiator.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved internal combustion engine embodying the principles and concepts of the present invention will be described.

Figure 1:
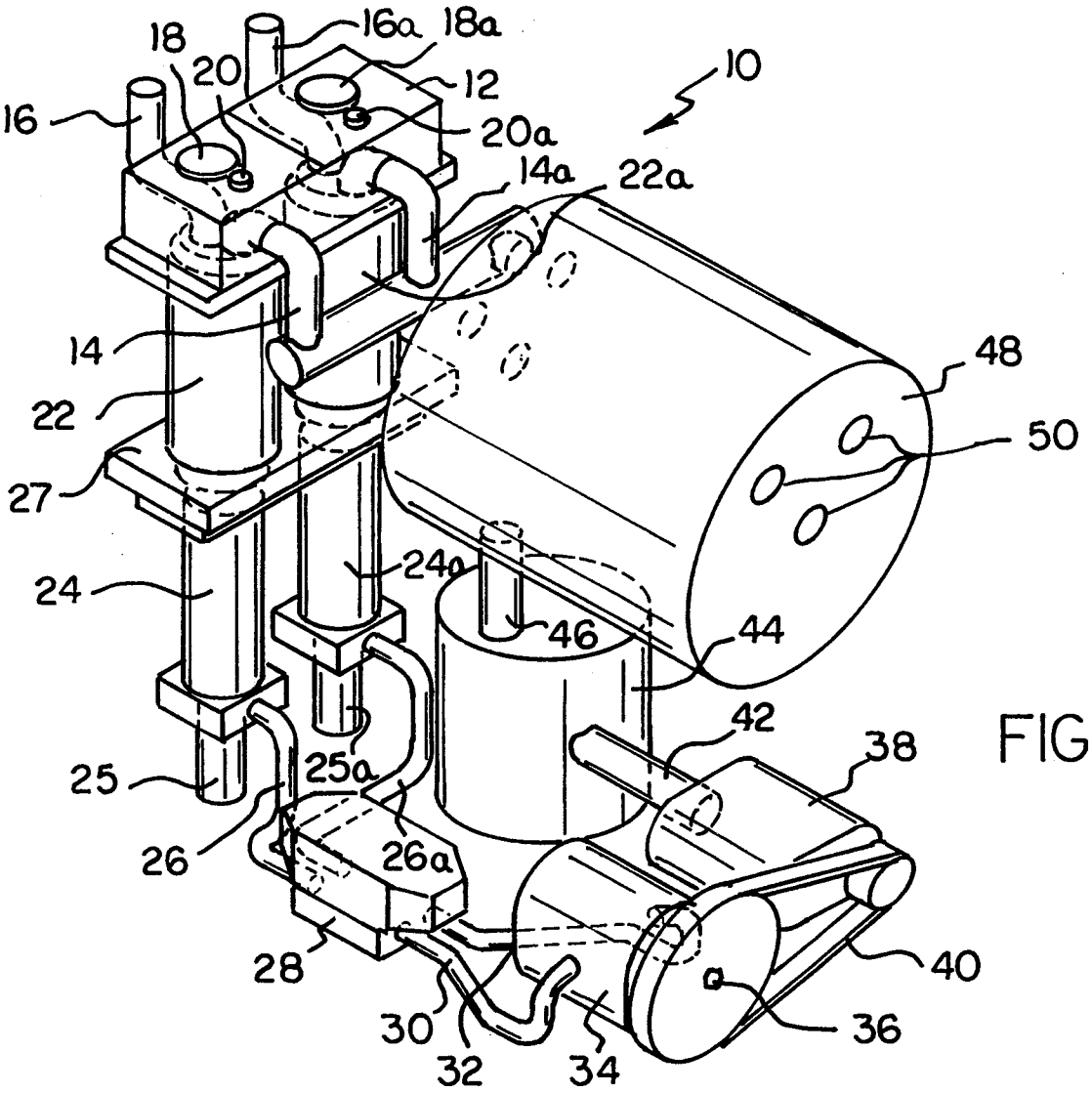
FIG. 1 is a perspective schematic diagram of the basic components of the internal combustion engine of the invention.

Referring initially to FIG. 1, the general organization of the internal combustion engine of the present invention is schematically illustrated. In the exemplary embodiment shown, the engine represented generally by reference numeral 10 has two cylinders each of which operates on the well known two-stroke principal. That is, on the intake or power stroke, the exhaust valve is closed, the intake valve is open for a predetermined portion of the stroke, and the spark plug or other ignition device is fired when the intake valve closes; whereas on the exhaust stroke, the piston returns to its top dead center position and at a predetermined portion of the stroke, the exhaust valve opens. The cycle is then repeated. In the second cylinder, the same sequence occurs, but one hundred eighty degrees out of phase.

As schematically depicted in FIG. 1, the cylinder head 12 for both cylinders includes a pair of intake ducts 14, 14*a*, a pair of exhaust ducts 16, 16*a*, separate pairs of intake and exhaust valve assemblies 18, 20 and 18*a*, 20*a*, respectively. The cylinder head is suitably mounted on and generally above the engine block which defines a pair of cylinders 22, 22*a* in each of which a piston head and piston rod assembly is suitably mounted by conventional piston rings for up and down travel along the longitudinal axis of each cylinder, respectively.

In accordance with the present invention, instead of connecting each piston rod to a rotatable crank or crank shaft at the bottom thereof, each piston rod is directly coupled through a manifold 27 to a corresponding piston assembly in hydraulic cylinders 24, 24*a*, respectively. Each hydraulic cylinder produces a high pressure output in hydraulic lines 26, 26*a* in response to downward movement of the piston in cylinders 22, 22*a*, respectively. Hydraulic lines 26, 26*a* are connected to a solenoid operated, hydraulic switching valve 28 which, in turn, is connected by a further pair of hydraulic lines 30, 32 to a conventional hydraulic motor 34 having a rotatable output shaft 36. Thus, the power output represented by the rotation of shaft 36 is the power output of the engine of the present invention. As well known by those of ordinary skill in the engine art, shaft 36 may be coupled to suitable transmission means (not shown), the details of which are outside the scope of the present invention, to facilitate performing useful work such as powering a vehicle, boat, and the like.

The solenoid which controls hydraulic valve 28 is actuated such that in one condition thereof determined by the TDC position of the piston in cylinder 22, high pressure hydraulic fluid flows from cylinder 24 through lines 26 and 30 to the input side of hydraulic motor 34, then through lines 32, 26*a* to hydraulic cylinder 24*a*. Then, when the piston in second cylinder 22*a* reaches TDC, the solenoid is actuated to a second condition whereupon valve 28 is reversed so that high pressure hydraulic fluid circuit is established through lines 26*a*, 30, 32, and 26. Hence, by the action of hydraulic valve 28, the direction of rotation of shaft 36 may be maintained as the pistons travel up and down in cylinders 22, 22*a*. The electrical signals applied to the hydraulic valve solenoid are derived from the engine's central computer as will be explained in more detail below.

In accordance with another feature of the present invention, a continuous belt driven by a suitable sprocket on engine output shaft 36 drives a conventional rotary air compressor 38 the output of which is applied through duct 42 to oil separating tank 44 which removes most, but not all oil injected into the high pressure air stream by compressor 38. The small quantity of oil remaining in the high pressure air output traveling along duct 46 and then into air tank 48 ultimately serves to lubricate the intake and exhaust valves and the piston rings in the combustion chambers of main cylinders cylinder head 12 and main cylinders 22 and 22*a*. Air tank 48 serves as a reservoir for high pressure air which latter is used for two purposes, namely, i) as a component of the explosive fuel air mixture fed through the intake valves into the main cylinders 22 and 22*a*, and ii) as the working fluid to actuate the intake and exhaust valves. Thus, suitable connections extend between the air tank 48 and intake ducts 14, 14*a*; and between the air tank and the cylinder head 12, respectively. A conventional fuel pump (not shown) delivers gasoline or other combustible liquid fuel a duct which, in turn, is connected to an injector suitably located in the wall of cylinder head 12 and opening into the manifold or duct leading to intake valves 18, 18*a*. Preferably, air tank 48 is fitted with a series of intercooler tubes 50 for maintaining the pressure of the air in tank 48 below a predetermined maximum. It will be appreciated that the rotary screw compressor 38 which compresses the air to feed into the combustion chamber of each main cylinder and which provides the working fluid for actuating the intake and exhaust valves consumes only a relatively small fraction of the useful output of engine 10, say on the order of about 10% to about 15%.

Figure 2:
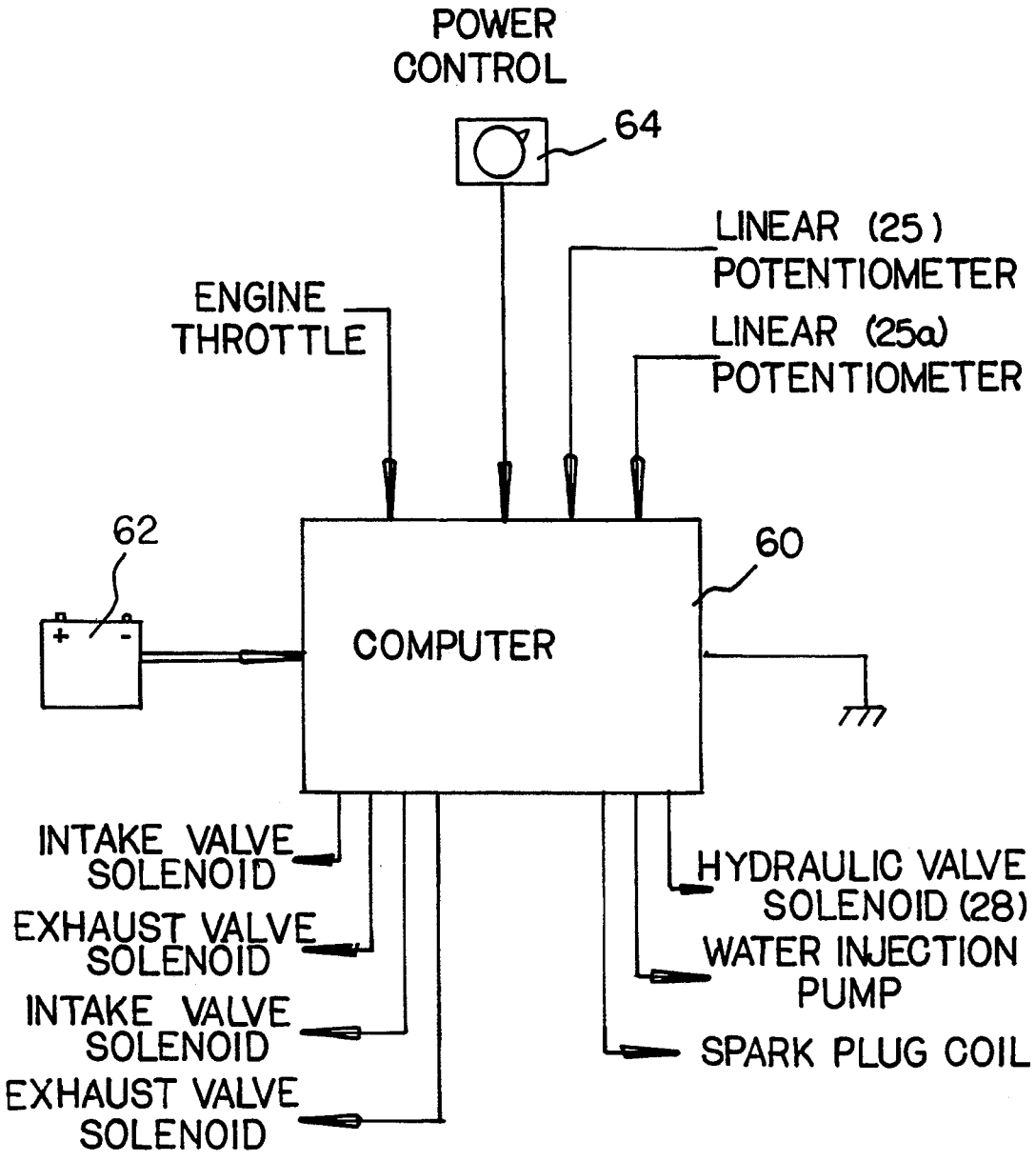
FIG. 2 is a block diagram of the computer control system of the engine of the present invention.

FIG. 2 shows a schematic diagram of the control system of the internal combustion engine 10 according to the invention. A digital computer 60 is suitably connected to a standard LSI battery 62 and is suitably adapted to receive several input signals and process these in accordance with instructions stored in the computer's internal memory so to control the operation of the various components described above in connection with FIG. 1 in their desired extent and sequence. Thus, signals from the engine's throttle are transmitted to the computer 60 along with signals from potentiometer 25, 25*a* indicating the instantaneous position of each cylinder head in each main cylinder whereupon this information is automatically processed by the computer to develop appropriate output signals to actuate the solenoids for the intake and exhaust valves, the hydraulic reversing valve 28 and other crucial engine functions all in accordance with pre-programmed instructions stored in the computer.

A manually operable power switch 64 may also be provided adapted to override the computer's automatic or default instructions and maintain the intake valve of each main cylinder open for a longer or shorter period of time than the default setting. Thus, if computer 60 is programmed to maintain the intake valves open for say, 10% of the intake stroke (e.g. the "default" condition), manual switch 64 may be actuated to increase the intake valve open interval to say, 30% of the intake stroke thereby increasing the power output of the engine.

Computer 60 may suitably be programmed to automatically perform other engine functions including, but not limited to providing proper timing signals for the water injection pump (to be described in more detail below); to provide proper timing signals for actuating the engine's spark plug coil, and so on. In respect to the present disclosure, it will be understood that computer 60 is a conventional general purpose programmable digital computer comprising a microprocessor, random access memory, control circuitry, analog-to-digital and digital-to-analog converters, and so on, the particular details of construction and operation of which are well known and outside the scope of the present invention.

Figure 3:
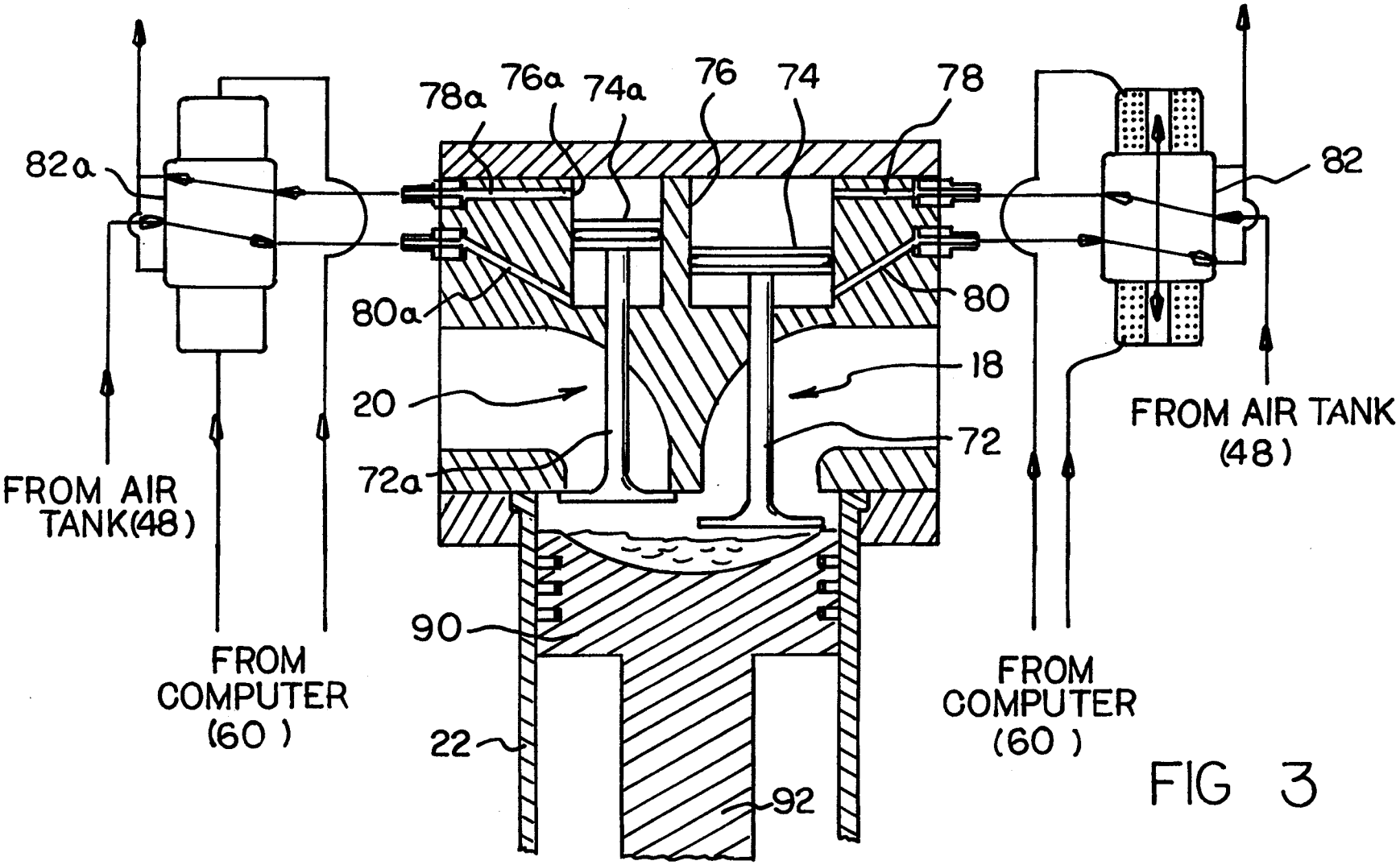
FIG. 3 is an elevational cross-sectional view showing the system for operating the intake and exhaust valves of one cylinder of the internal combustion engine of the invention.

As mentioned above, an important feature of the present invention is the lack of a rotating crank shaft and the need to use a friction producing mechanical rocker arm assembly to actuate the intake and exhaust valves. Turning to FIG. 3, the novel valve actuation means of the invention are shown. Intake valve 18 comprises a stem 72 attached to a piston 74 at the top distal end thereof. Piston 74 is adapted for up and down travel in an air cylinder 76. A pair of passageways 78, 80 in the sidewall of cylinder head 12 are connected to a solenoid air valve 82 which functions in response to appropriate timing signals from computer 60 to permit high pressure air fed from tank 48 to valve 80 to flow through air passages 78, 80 on either side of air piston 74 thereby to control the up and down travel of valve stem 72 and the operation of intake valve 20 in a manner believed apparent.

Similarly, exhaust valve 20 comprises a stem 72*a* attached to a piston 74*a* at the latter's distal top end. Piston 74*a* is adapted for up and down travel in an air cylinder 76*a*. A pair of passageways 78*a*, 80*a* in the sidewall of cylinder head 12 are connected to a solenoid air valve 82*a* (identical to solenoid valve 82) which functions in response to appropriate timing signals from computer 60 to permit high pressure air fed from tank 48 to valve 80*a* to flow through air passages 78*a*, 80*a* on either side of air piston 74*a* thereby to control the up and down travel of valve stem 72 and the operation of exhaust valve 20.

It thus will be appreciated that under control of computer 60, solenoid air valves 82, 82*a* function to actuate intake and exhaust valves 18, 20 in a proper timed sequence depending upon throttle opening, the instantaneous position of main piston head 90 and piston rod 92 in cylinder 22 (as sensed by linear potentiometer 25) and other factors (e.g. manifold pressure in cylinder head 12) applied to computer 60 in the form of electrical input signals so as to achieve maximum power output and operating efficiency. More importantly, in accordance with the operating principals of the engine of the present invention when the throttle is completely closed, the engine is in idle with no rotating crank shaft, i.e. the output shaft 36 of hydraulic motor is stationary and all other parts are in a "stand still" condition. This mode of operation constitutes an obvious, substantial efficiency advantage over conventional "rotating crank" internal combustion engines.

Figure 4:
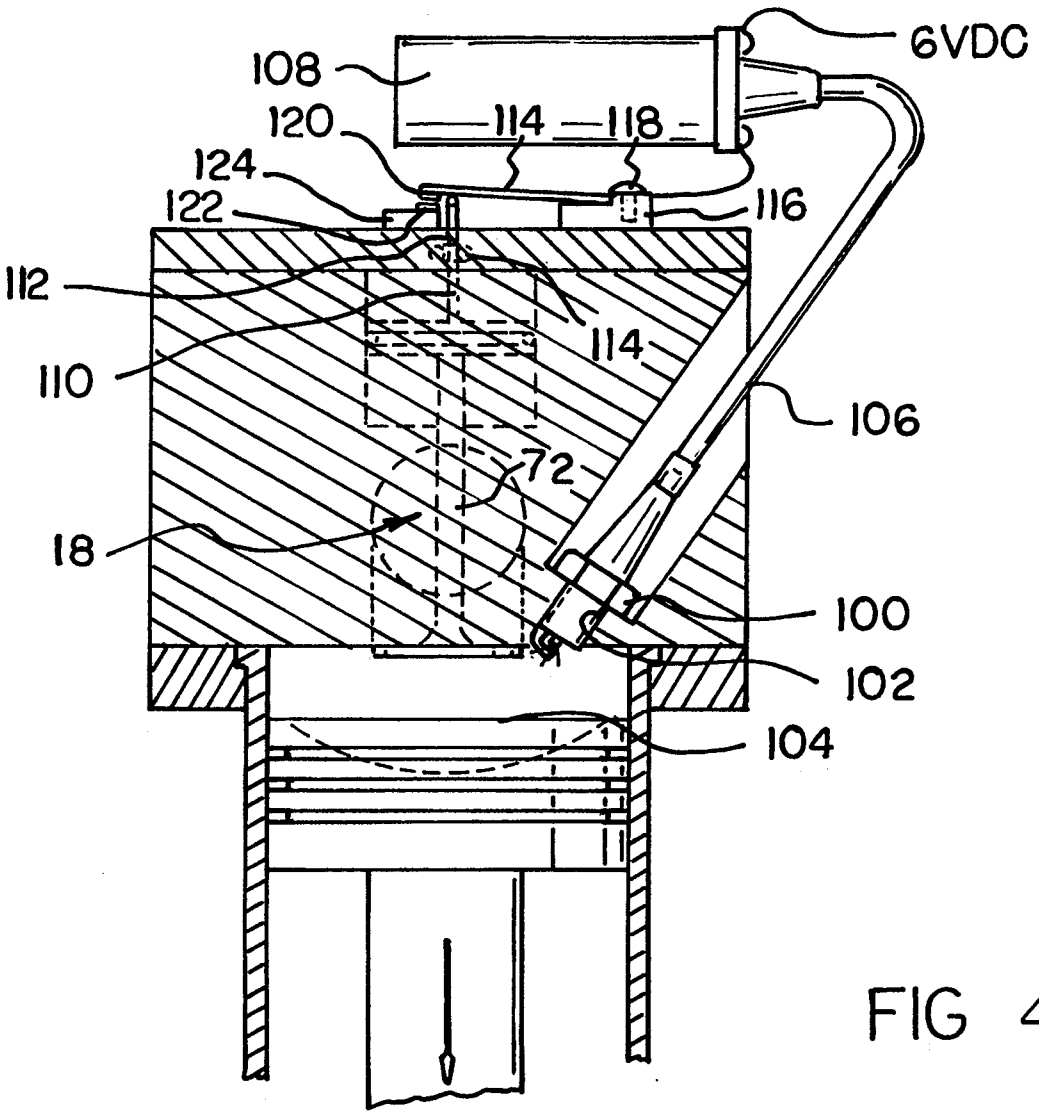
FIG. 4 is an elevational cross-sectional view showing the spark plug system for igniting the fuel and high pressure air mixture injected into one cylinder of the internal combustion engine of the invention during the power stroke.

Turning to FIG. 4, there is shown the preferred arrangement for mounting a spark plug assembly in cylinder head 12. Spark plug 100 is threadedly received in a complimentary female threaded port 102 communicating with main combustion chamber 104 substantially as shown. A conductor 106 extends from spark plug 100 to ignition coil 108 which latter is conveniently and suitably mounted near cylinder head 12. Although computer 60 is capable of generating electronic ignition signals to "energize" coil 108 through an appropriate relay or breaker switch, an alternatively preferred method is contemplated wherein the coil is actuated directly by the position of the intake valve 18. Such alternatively preferred means comprises an extension or rod 110 affixed to the top of air piston 74 and adapted for slidable up and down travel in an opening 112 in cylinder head 12 which latter is sealed against air leakage by packing 114. The distal end or tip of rod 110 bears against a leaf spring breaker arm 114 cantilever mounted on insulated block 116 by screw 118. The end of breaker arm 114 terminates in a contact 120 adapted to engage similar contact 122 carried on insulated mounting block 124. Contact 122 is suitably connected to ground. When intake valve 18 is closed, rod 110 will open the contacts 120, 122 energizing coil 108 and firing spark plug 100 thereby initiating the power stroke by combustion of the fuel air charge in combustion chamber 104. During the exhaust stroke, valve 18 remains closed, contacts 120 and 122 are engaged and the coil's capacitor is charged for the next cycle. The coil will not fire the spark plug again until the beginning of the power stroke when valve 18 once again closes. In use, it will be apparent that the mechanical circuit breaker system just described will be fitted one to each cylinder of the engine.

Figure 5:
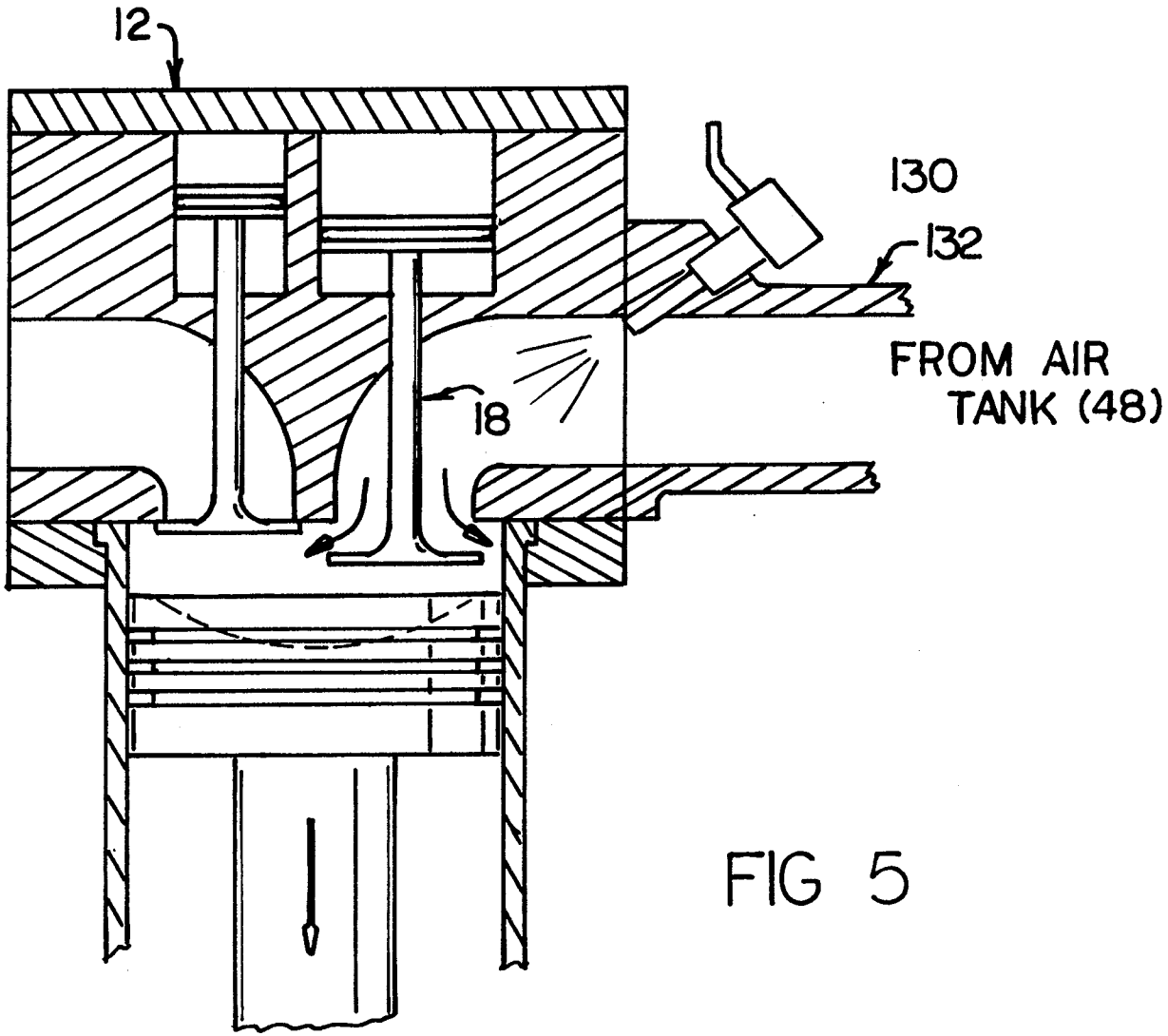
FIG. 5 is an elevational cross-sectional view showing the system for injecting a mixture of fuel and high pressure air into one cylinder of the internal combustion engine of the invention.

FIG. 5 depicts a conventional fuel injector 130 suitably mounted in the wall of intake manifold 132. The injector is controlled by computer 60 to charge the high pressure airstream from tank 48 with an optimum quantity of fuel after intake valve 18 has been opened at the beginning of the power stroke.

Figure 6:
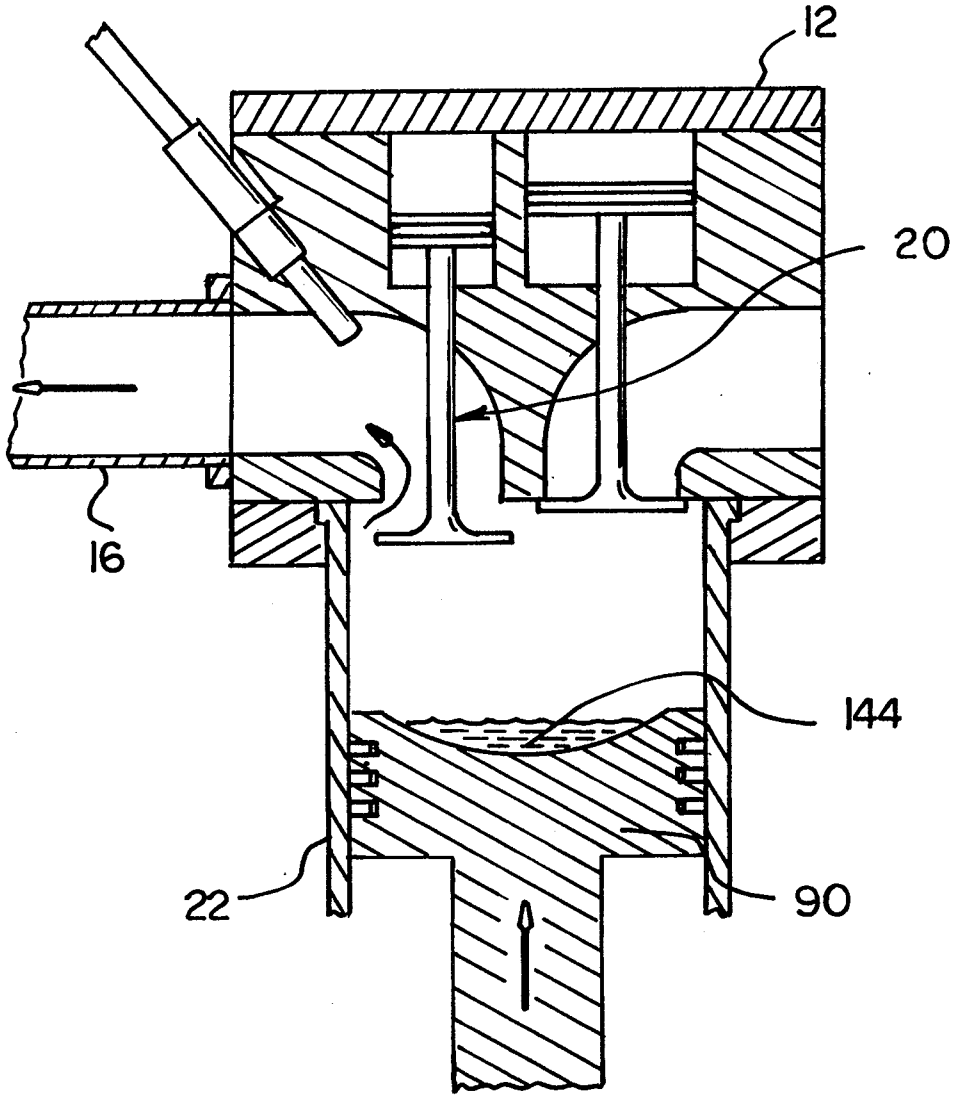
FIG. 6 is an elevational cross-sectional view showing the water injection system employed with one cylinder of the internal combustion engine of the invention.

Still another important advantage of the internal combustion engine of the present invention is that the need for a conventional radiator cooling system is obviated. While it is necessary to prevent overheating within each combustion chamber due to the fact that the fuel/air mixture is compressed, this may be accomplished with the relatively simple means depicted in FIG. 6. As shown therein, a conventional water jet injector 140 is suitably mounted in the cylinder head wall such that the nozzle thereof opens into exhaust manifold 142. Although not shown, it will be understood that injector 140 is suitable connected to a supply tank of water by a flexible conduit or hose and that a water pump is interconnected with the hose so that when actuated by an appropriate timing signal from computer 60 (see FIG. 2), a pulse of pressure is applied along the hose sufficient to inject a predetermined quantity of water into combustion chamber 104 when exhaust valve 20 is open. In addition, the top surface of main piston 90 is provided with a concavity or dished portion 144 substantially as depicted to serve as a reservoir for the injected amount of water. As the piston is caused to begin its power stroke and the spark plug fires, the water in concavity 144 will vaporize effectively lowering the maximum combustion temperature that would otherwise appertain in the absence of water injection according to the present invention.

The use and operation of the internal combustion engine of the invention is believed apparent from the above description.

From the foregoing, it is evident that a new and improved internal combustion engine has been disclosed as required by statute and which has greatly improved efficiency, is relatively low in cost to build, use and maintain, that has no moving crank shaft or other parts when the engine is in idle, and that requires no cooling radiator system.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein.

Hence, the proper scope of the present invention should be determined only by the broadest interpretation of the appended claims so as encompass all such modifications and equivalents.

What is claimed as being new and desired to be protected by Letters Patent of the United States is as follows:

1. A new and improved internal combustion engine comprising:

a cylinder, said cylinder having a combustion chamber and a piston head and rod assembly for movement up and down in said cylinder relative to said combustion chamber, said cylinder further having an intake valve assembly and an exhaust valve assembly interconnected with said combustion chamber, said piston head and rod assembly being operatively connected to a hydraulic piston movable in a hydraulic cylinder to produce a high pressure hydraulic output in response to said up and down movement of said piston head and rod assembly, a hydraulic motor a conduit connected between said hydraulic cylinder and said hydraulic motor, said hydraulic motor having a rotatable output shaft adapted to be rotated in response to the high pressure output from said hydraulic cylinder applied to said motor through said conduit, and valve-actuating means connected between said hydraulic motor and said combustion chamber for actuating said intake and exhaust valve assemblies in a predetermined timed sequence, wherein said intake and exhaust valve assemblies are operated by pressurized air, and said valve-actuating means comprises an air compressor connected to the output of said hydraulic motor, a pair of air-pressure operable valves connected to said air compressor, said air-pressure operable valves being interposed between said air compressor and said intake valve and said exhaust valve assemblies, respectively, and means for controlling the operation of said air-pressure operated valves in said predetermined timed sequence.

2. The invention of claim 1 wherein said means for controlling comprises a digital computer.

3. The invention of claim 2 wherein said hydraulic cylinder includes means for generating an electrical signal representing the instantaneous position of said hydraulic piston in its path of travel, said electrical signal being applied as an input to said digital computer.

4. The invention of claim 3 wherein said engine includes throttle means, said throttle means being connected to said digital computer to provide a further input signal proportional to throttle opening, wherein said digital computer is responsive to said input signal from said means for generating an electrical signal representing the instantaneous position of said hydraulic piston and to said further input signal from said throttle means to generate an output signal, said air-pressure operated valves each including solenoid means responsive to said computer output signal.

5. The invention of claim 1 further including water injection means for introducing a predetermined quantity of water into said combustion chamber, and a concavity in the top surface of said piston head of said piston head and rod assembly for receiving therein said predetermined quantity of water.

6. The invention of claim 1 wherein said valve-actuating means further includes a holding tank interposed between said air-pressure operable valves and said air compressor.

7. The invention of claim 3 wherein said means for generating an electrical signal representing the instantaneous position of said hydraulic piston comprises a linear potentiometer connected to said hydraulic piston.

8. The invention of claim 2 further including spark plug means and ignition coil means adapted to generate a spark to ignite a fuel air charge introduced into said combustion chamber through said intake valve assembly, electrical means between said spark plug means and ignition coil means and said computer for actuating said spark plug means and ignition coil means in a timed sequence relative to movement of said piston and piston rod assembly in said cylinder.

9. The invention of claim 2 further including spark plug means and ignition coil means adapted to generate a spark to ignite a fuel air charge introduced into said combustion chamber through said intake valve assembly, actuation means between said spark plug means and ignition coil means and said intake valve means for actuating said spark plug means and ignition coil means in a timed sequence relative to movement of said intake valve and said piston and piston rod assembly in said cylinder.

* * * * *